US006679021B2

(12) United States Patent
Maimon et al.

(10) Patent No.: US 6,679,021 B2
(45) Date of Patent: Jan. 20, 2004

(54) MODULAR WALL SEGMENTS

(76) Inventors: Eliyahu Maimon, Yekutiel Adam 10, Haifa Bay (IL); Oren Dror, 2 Montifiori Street, 43 335 Raanana (IL)

( * ) Notice: Subject to any disclaimer, the term of this patent is extended or adjusted under 35 U.S.C. 154(b) by 63 days.

(21) Appl. No.: 10/032,455

(22) Filed: Jan. 2, 2002

(65) Prior Publication Data

US 2002/0108336 A1 Aug. 15, 2002

(30) Foreign Application Priority Data

Feb. 15, 2001 (IL) ..... 141467

(51) Int. Cl.[7] ..... E04B 2/02

(52) U.S. Cl. ..... 52/592.1; 52/271; 52/281; 52/286; 52/309.17; 52/586.1

(58) Field of Search ..... 52/238.1, 266, 52/271, 281, 286, 309.9, 309.12, 309.14, 309.17, 582.1, 586.1, 586.2, 585.1, 590.2, 591.1, 592.1, 784.14, 784.15, 793.1, 794.1, 800.1, 745.1, 745.13

(56) References Cited

U.S. PATENT DOCUMENTS 1,188,065 A * 6/1916 Gilbert ..... 52/354
2,366,156 A * 1/1945 Simonson ..... 52/745.1
3,420,023 A * 1/1969 Gregori ..... 52/309.9
3,623,288 A * 11/1971 Horowitz ..... 52/264
3,844,075 A * 10/1974 Tolleson et al. ..... 52/100
4,021,983 A * 5/1977 Kirk, Jr. ..... 52/451
4,098,040 A * 7/1978 Riefler ..... 52/223.7
4,306,396 A * 12/1981 Iotti ..... 52/238.1
4,651,485 A * 3/1987 Osborne ..... 52/284
4,802,318 A * 2/1989 Snitovski ..... 52/309.12
4,852,310 A * 8/1989 Henley et al. ..... 52/91.3
5,353,562 A * 10/1994 Decker ..... 52/309.7
5,485,703 A * 1/1996 Nordahl ..... 52/562
5,964,067 A * 10/1999 Lehner et al. ..... 52/220.2

FOREIGN PATENT DOCUMENTS

GB 2057529 A * 4/1981 ..... 52/586.1
SU 926187 * 5/1982 ..... 52/238.1

* cited by examiner

*Primary Examiner*—Brian E. Glessner
(74) *Attorney, Agent, or Firm*—G. E. Ehrlich Ltd.

(57) ABSTRACT

A modular wall segment for constructing a wall includes two walling sheets of selected size and shape bonded to the opposite faces of a plurality of contiguously placed aerated concrete blocks. The segments may be formed with end faces defining slots of various configurations for receiving various types of fastening elements to enable a plurality of such segments to be secured together in a modularized fashion.

18 Claims, 13 Drawing Sheets

237
231
235
237
233
234

237

233
237
234

MODULAR WALL SEGMENTS

FIELD AND BACKGROUND OF THE INVENTION

The present invention relates to a modular wall segment construction, to methods of making such segments, and to uses of such segments in the construction of walls.

Construction methods currently in popular use in many locations and climates are typically slow and labor-intensive. In Israel, for example, most constructions of interior walls rely on methods substantially unchanged over many years. Interior walls built in Israel, as well as those built in many similar climates, are typically constructed of cinderblock or of cement-based blocks of other types (referred to collectively hereinbelow as "construction blocks"), built into a wall by masons on the construction site, then covered by hand with a mixture of cement and fine sand, and finally finished by paint or plaster. Openings for doors and windows are measured on site and built into the block-based construction by hand, and channels for electrical and plumbing conduits are typically chiseled by hand into the constructed wall.

The popular construction process here described is not only slow and labor intensive, but also requires a high degree of skill and workmanship. Any failure in the workmanship may result in unevenness in the wall surface, or inaccurate placement of planned fixtures.

Alternative methods for the construction of interior non-loadbearing walls involve the use of broad prefabricated sheets of walling material, such as sheetrock, wallboard, gypsum board, DENSEGLASS, sheetrock, concreteboard or plasterboard. Such materials, referred to collectively hereinbelow as "walling sheets", are often used together with a variety of insulating materials to produce interior walls. To construct a wall using walling sheets, a worker typically erects a metal or plastic frame at the desired location of the wall, and then attaches walling sheets to both sides of the frame, and, optionally, fills the space between the pair of walling sheets with insulating material.

Walls constructed of walling sheets are typically built more rapidly than those built of construction blocks, and have the advantage that the walling sheets themselves are smooth and typically present a fairly aesthetic and finished appearance, once attached to a frame. Therefore, building walls using walling sheets may be accomplished by workers having less professional skill than those required to erect a smooth, vertical, and well-finished wall using construction blocks. Both the greater rapidity of construction, and the lower skill requirements for the construction workers, are reflected in substantially lower construction costs for walls built of walling sheets in modular units. However, walls built using walling sheets are typically of lower quality than those built using construction blocks. In particular, walls built of walling sheets are typically less strong and less solid than walls built of construction blocks, and their thermal and acoustic insulating qualities are inferior.

Thus, there is a widely recognized need for, and it would be highly advantageous to have, a construction material and method of construction which provide the relative rapidity, simplicity and reduced manpower costs of modular construction, as well as the smooth, aesthetic, and highly finished appearance of walls constructed with walling sheets, together with the high-quality, strength, solidity and good acoustic and thermal insulating properties, of walls constructed with construction blocks.

Under construction practices typically in use at construction sites in Israel and in many other locations, responsibility for implementing the detailed plans provided by architects and engineers for accurately measuring and accurately implementing the correct placement of openings for doors and windows, for communication and electrical conduits, and for pipes and other conduits, typically falls on the masons constructing the walls. The fact that primary responsibility for accurate placement of such features is in the hands of on-site masons or other construction workers building the walls further reinforces the need for highly skilled, and consequently relatively expensive, construction workers on the construction site.

Thus, there is further a widely recognized need for, and it would be highly advantageous to have, a construction material and a method of construction which enable the building of walls having openings and fixtures which are elegantly finished and accurately placed according to architects' and engineers' specifications, yet which do not require highly skilled personnel at the construction site.

Prior art methods for building walls further include the use of pre-fabricated modular wall segments each comprising a pair of walling sheets sandwiching between them an insulating material of some sort. Argal, Calcar, and various polyurethane-based compositions have been used as insulating material in this context. The modular wall segments thereby produced do allow relatively easy wall construction, yet they fail to provide the solidity and acoustic and thermal isolating properties comparable to those obtained with masonry walls built of construction blocks. Moreover, many such materials have been found to be flammable, or to emit poisonous gasses into the surrounding environment when heated. For this and other reasons, available pre-fabricated modular wall segments comprising walling sheets surrounding an insulating material do not meet the minimum acceptable standards required under the building codes in force in Israel and in various other localities.

Thus there is further a widely recognized need for, and it would be highly advantageous to have, a construction material and a method of construction providing the advantages of rapidity and simplicity of modular construction and the solidity and insulating qualities of construction-block construction, while utilizing material components which are not flammable and which cause no harmful emissions to the environment when heated, and which are already recognized as acceptable building materials according to common practice and according to the legal requirements of the building codes in force in many localities.

In localities which suffer periodic earthquakes, the dangers and disadvantages of falling masonry construction blocks are well known. Falling masonry construction blocks comprising the walls of a building may be responsible for damage to property and injury and death to people, even in cases where the well-constructed load-bearing skeleton of the building (e.g., the reinforced concrete sections) survive an earthquake relatively intact.

Thus there is further a widely recognized need for, and it would be highly advantageous to have, a construction material and a method of construction which minimizes the danger of falling walls and wall components during earthquakes.

SUMMARY OF THE INVENTION

According to one aspect of the present invention, there is provided a modular wall segment for constructing a wall, comprising: (a) a first walling sheet of a selected two-dimensional shape and size; (b) a second walling sheet of the selected two-dimensional shape and size; and (c) a plurality of aerated concrete blocks contiguously located in a plurality of rows and columns between said first and second walling sheets to form a volume of consistent thickness of the selected two-dimensional shape and size; the plurality of aerated concrete blocks being bonded on their opposite faces to the first and second walling sheets.

According to some described preferred embodiments, the aerated concrete blocks are contiguously placed in direct contact with each other and are secured together within the modular wall segment solely by the external layers. Another embodiment is described wherein the aerated concrete blocks include a quantity of a bonding material between them to augment their securement together within the modular wall segment by the external layers.

According to further features in the described preferred embodiments, the modular wall segment is formed on at least one end face with a slot for receiving a fastening element to secure the modular wall segment to other modular wall segments. Various embodiments described below illustrate various types of configurations of slots, and of fastening elements to be received in such slots, for utilizing the segments in a modular manner to construct a wall or a juncture with a floor or ceiling.

The present invention thus addresses the shortcomings of the presently known configurations by providing a construction material and a method of construction which enable low-cost wall construction by utilizing the rapidity and simplicity of modular wall construction techniques, yet which produce high-quality, strong and solid walls whose acoustic and thermal insulating properties are comparable to those found in walls built using constructions blocks.

The present invention further addresses the shortcomings of the presently known configurations by providing a construction material and a method of construction which enable building walls with highly accurate placement of openings and fixtures, yet which do not require highly skilled personnel at the construction site.

The present invention still further addresses the shortcomings of the presently known configurations by providing a construction material and a method of construction providing the rapidity and simplicity of modular wall construction and the solidity and insulating qualities of construction-block construction, while enabling the utilization of materials which cause no harmful emissions to the environment and which are widely recognized and accepted as building materials both according to common practice and according to the building codes in force in a wide variety of locations.

The present invention still further addresses the shortcomings of the presently known configurations by providing a construction material and a method of construction which minimize danger of falling walls and wall components during an earthquake.

Further features and advantages of the invention will be apparent from the description below.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DESCRIPTION OF PREFERRED EMBODIMENTS

Figure 1:
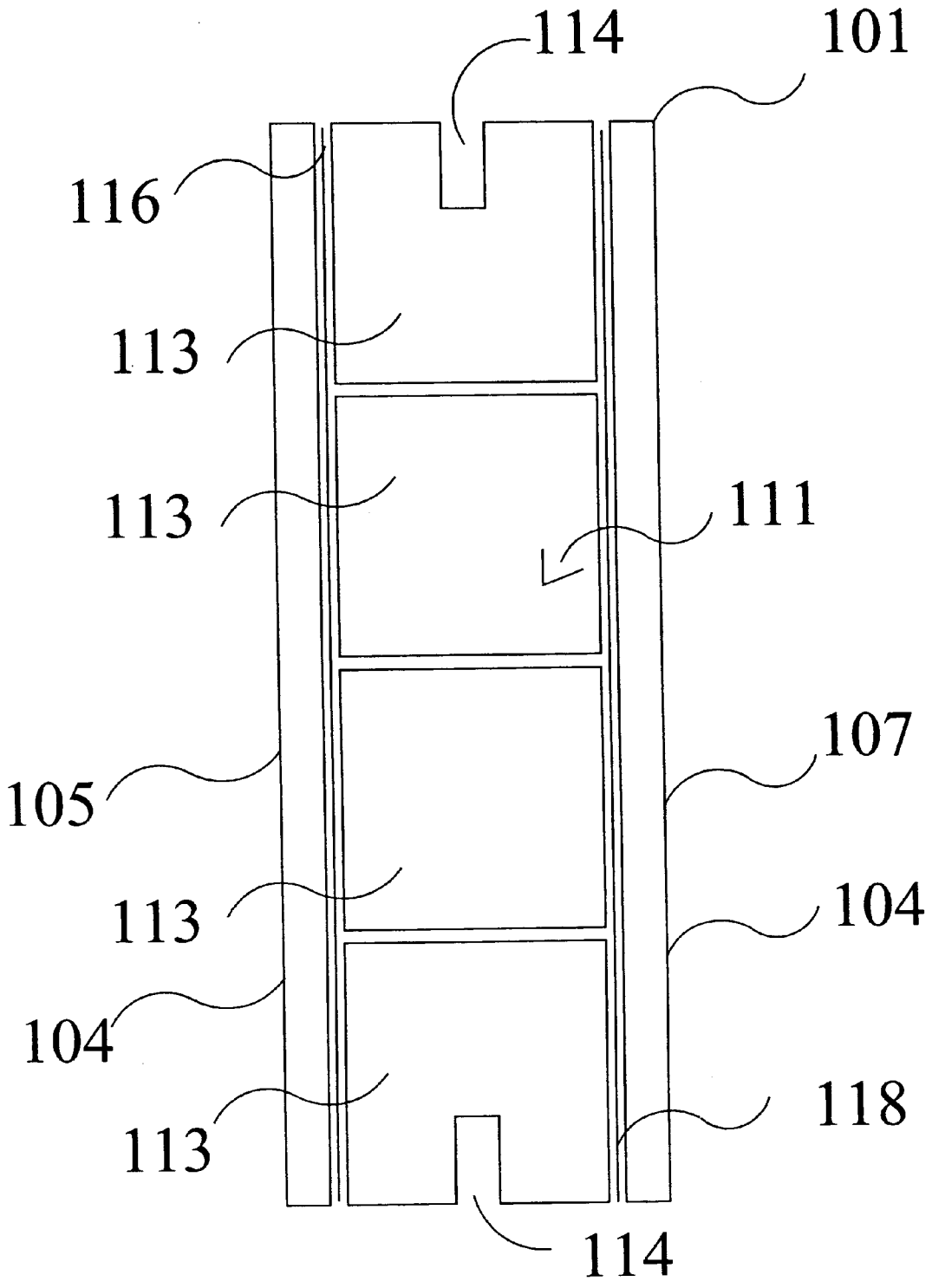
FIG. 1 is a simplified cross-section of a modular wall segment according to an embodiment of the present invention.

The present invention involves a modular wall segment comprising an inner layer of aerated concrete blocks glued between two outer layers, methods for constructing same, and uses thereof. Specifically, the present invention can be used to construct walls which combine the advantages of modular construction, easy and rapid installation, and aesthetic appearance, with the solidity and thermal and acoustic isolating qualities of construction-blocks.

To enhance clarity of the following descriptions, the following phrases will first be defined:

The phrase "aerated concrete block" is used herein to refer to a block suitable for use as a building material, containing cement, sand, and other materials, and having a highly porous internal structure or a cellularized internal structure. Such blocks may be produced, for example, by a process of mixing cement, sand, lime, cement, and a foaming agent with water and pouring into a mold. The foaming agent causes tiny bubbles to develop within the cement mixture. The bubbles remain interspersed within the cement mixture. When the mixture hardens, these tiny bubbles are permanently fixed within the block structure, resulting in a cement-based construction block having an internal cellular structure which includes multiple small spaces formed by the bubbles created by the foaming process. The block thereby formed is strong and solid and is a good thermal and acoustic insulator, yet is significantly less dense than would be a block formed of a comparable mixture of cement, sand, lime and water without the use of a foaming agent. In a typical fabrication process, the mixture is poured into a form, foams up to about double its volume, is kept moist, and is allowed to set for about 90 minutes, after which it is hard enough so that it can be moved, or cut to desired dimensions.

Construction blocks marketed under the trade name YTONG and construction blocks marketed under the trade name ESHKOLIT are examples of aerated concrete blocks. It is noted that it is the cellularized or highly porous character of the blocks, and their relatively low density when compared to standard cement-based blocks, which are their defining characteristics. Aerated concrete blocks may be produced by the foaming process described hereinabove, or by any other process.

The phrase "walling sheets" is used herein to refer to any member of the general class of objects having a form which combines a relatively thin dimension, usually between several millimeters and several centimeters and most typically about one or two centimeters in thickness, with much larger width and height dimensions, typically from tens to several hundreds of centimeters in width and height, whose physical characteristics make them appropriate for use as partitioning elements in walls. Walling sheets typically have a generally smooth surface, aesthetically suitable for use in walls. Wood, for example plywood, wood composition boards, sheetrock, Gypsum board, cement-board, plasterboard, wallboard, and DENSEGLASS are examples of "walling sheets". It is noted that the expression "walling sheets" as used herein is not intended to be limited to the specific examples here mentioned. Rather, the expression "walling sheets" is intended to refer to any objects of size, shape, and physical characteristics similar to those of plywood, sheetrock, gypsum board, cement-board, plasterboard, wallboard and DENSEGLASS, making them appropriate for use as part of a wall structure.

The principles of the construction and use of wall modules according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 is a simplified cross-section of a modular wall segment according to an embodiment of the present invention. A modular wall segment 101 comprises two external layers, individually designated as first external layer 105 and second external layer 107, and an internal layer 111.

Each external layer 105, 107 is a walling sheet as defined hereinabove. Commercially available produces such as plywood, sheetrock, wallboard, plaster-board, cement-board, or DENSEGLASS may be used. These commercially available produces are, however, mentioned as illustrative examples only, and are not intended to limit the scope of the invention. Any object of similar shape and physical characteristics, whether commercially available or specifically prepared for the purpose, may be utilized as walling sheets and incorporated in modular wall segment 101 as external layers 105, 107.

Figure 2:
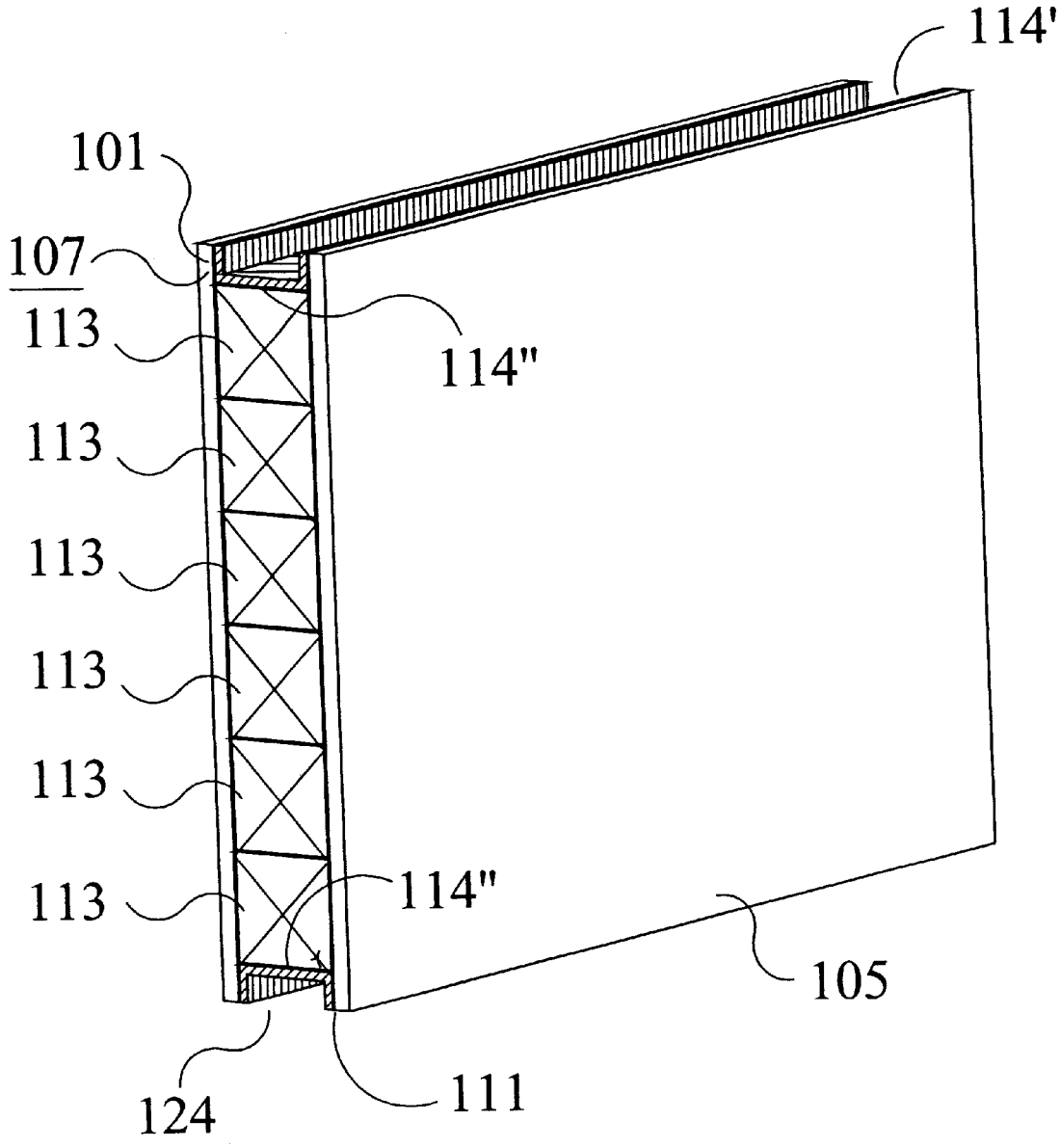
FIG. 2 is a simplified isometric illustration of a modular wall segment according to another embodiment of the present invention.
Figure 4A:
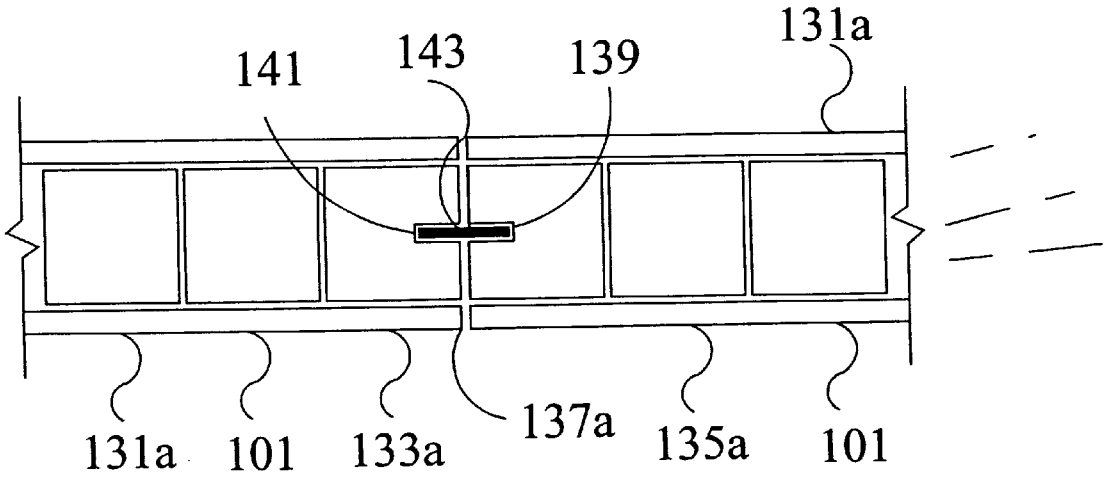
FIGS. 4*a* and 4*b* are simplified cross-sectional views of preferred methods for joining modular wall segments one to another to make a wall, according to an embodiment of the present invention.
Figure 4B:
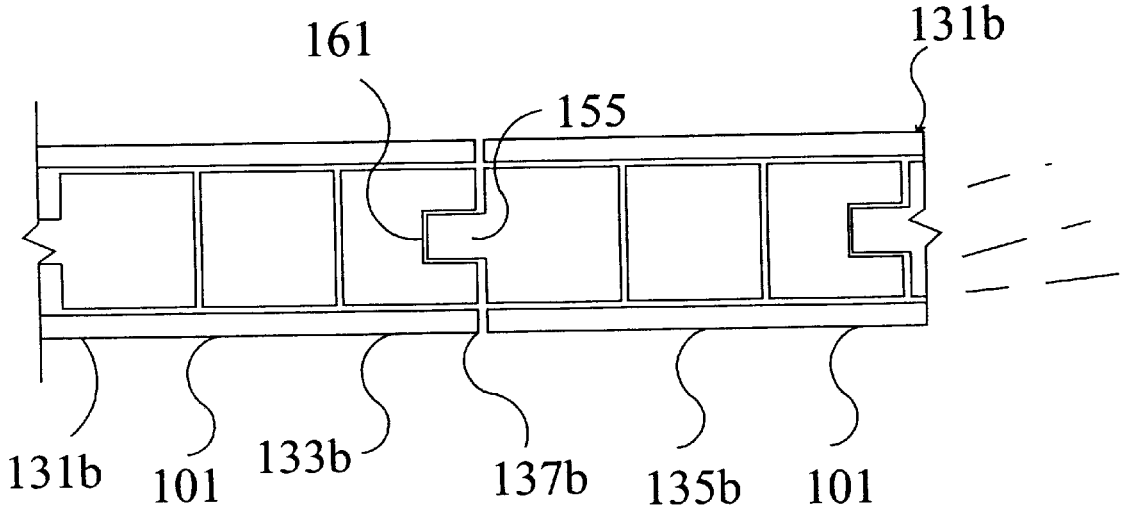

Internal layer 111 comprises a plurality of aerated concrete blocks 113 located in a plurality of rows and columns between the walling sheets 105, 107, as more particularly seen in FIGS. 2, 4*a* and 4*b*. Blocks 113 are shown as if slightly separated in FIG. 1, for clarity of the figure, but in practice blocks 113 are preferably contiguous one to another.

A first glue layer 116 between internal layer 111 and external layer 105, and a second glue layer 118 between internal layer 111 and external layer 107 serves to hold these layers of modular wall segment 101, together as a unit.

A slot 114 may be provided in exposed surfaces of certain blocks 113 at the end faces of the respective segment to facilitate joining the modular wall segment 101 to floors, ceilings, and to other modular wall segments. In the construction illustrated in FIG. 1, slot 114 extends transversely through the block 113 at the respective end face of the segment.

Reference is now made to FIG. 2, which is a simplified isometric illustration of a modular wall segment according to an embodiment of the present invention. FIG. 2 presents a modular wall segment 101 similar in structure and identical in purpose to modular wall segment 101 shown in FIG. 1. As an aid to understanding, the numbered features of FIG. 1 are reproduced in FIG. 2 in isometric perspective. Slot 114' in FIG. 2 is presented as a wide slot, whereas in FIG. 1 slot 114 is narrow. Slot 114 is formed in the end faces of the line of aerated concrete blocks at the respective end of the modular wall segment and extends parallel to the walling sheets 105 and 107. Slot 114' in FIG. 2 is defined by having the ends of the two walling sheets, 105, 107, project past the end face of the aerated concrete block 113 at the respective end of the segment, and a U-shaped channel member 114" is preferably introduced into that slot for reinforcement purposes. Both wide and narrow configurations of the slot 114 may be used for joining modular wall segment 101 to floors, ceilings and other modular wall segments. The relatively narrow slot 114 presented in FIG. 1 is a presently preferred configuration.

Figure 3:
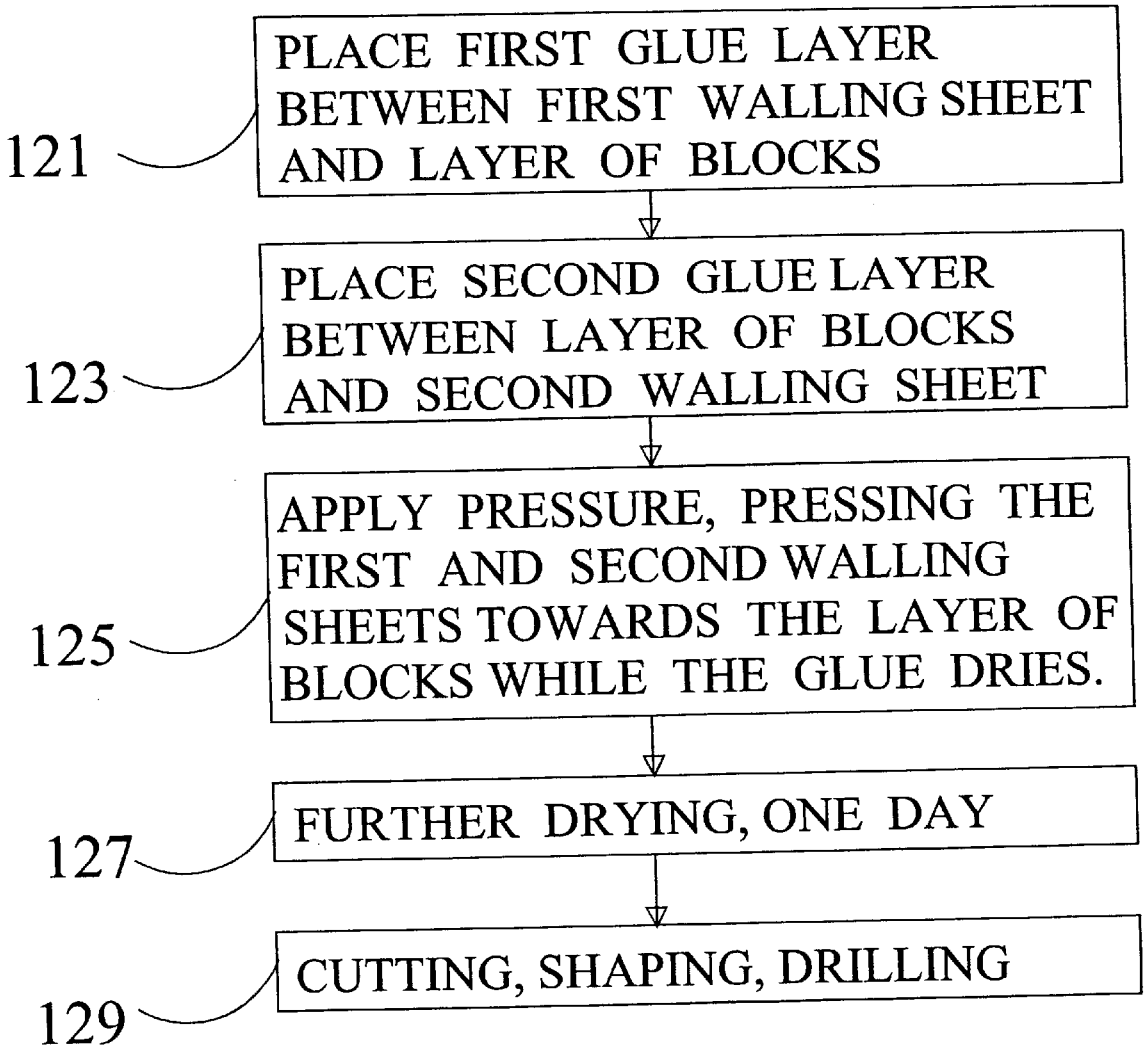
FIG. 3 is a simplified flow chart showing a preferred method for constructing a modular wall segment according to an embodiment of the present invention.

Reference is now made to FIG. 3, which is a simplified flow chart presenting a preferred method for constructing modular wall segment 101, according to any embodiment of the present invention.

A first walling sheet 104 substantially formed in a selected two-dimensional shape and size is used as a basis for construction. The selected two-dimensional shape is typically rectangular, but any selected shape, and any convenient size, may be used.

At step 121 a first glue layer 116 consisting of a polyurethane-based glue is placed between a first walling sheet used as a first external layer 105 and a plurality of aerated concrete blocks 113 which constitute internal layer 111. KLEIBERIT glue supplied by BECKER GMBH of Germany is a preferred glue for this purpose. Glue density of up to 375 gm per square meter, for each glue layer 116, is preferred.

A convenient way to place first glue layer 116 between external layer 105 and blocks 113 is to lay a first walling sheet on an assembly table, spread glue on the sheet, and then place aerated concrete blocks 113 on the glue-coated walling sheet. Blocks 113 are placed contiguously, in contiguous parallel rows, so that they together constitute a volume of constant thickness approximating the size and shape of the walling sheet. Blocks 113 are placed in rows in the classical staggered relationship. Neither glue nor any other binding material is required between contiguous blocks 113, as blocks 113 are held in place by glue layer 116 between blocks 113 and the walling sheet of external layer 105.

At step 123, a second glue layer 118 is placed between aerated concrete blocks 113 and a second walling sheet to serve as the second external layer 107. The shape and size of the second walling sheet preferably conforms to the two-dimensional shape and size of the first walling sheet defining the first external layer 105. The second glue layer 118 can conveniently be applied by coating the exposed (upper) side of blocks 113 with glue, and then placing the second walling sheet over the glue-coated blocks 113. At the conclusion of step 123, first external layer 105, internal layer 111, and second external layer 107 are placed relative to each other in the configuration shown as modular wall segment 101 in FIGS. 1 and 2 before the glue layers 116 and 118 intended to bind them together have solidified.

In step 125 pressure is applied to the construction in such a manner as to force both external layer 105 and external layer 107 to be pressed strongly into close contact with blocks 113 constituting inner layer 111, and to be held in close contact until glue layers 116 and 118 become set. In a preferred mode of operation pressure is applied by transferring the constructed layers from the assembly table to a pressure table while preserving the layers' spatial relationships, and then using the pressure table to apply pressure vertical pressure which forces layers 105, 111 and 107 to remain strongly pressed together while the glue dries. In a preferred method, a pressure of approximately 40 atmospheres per square centimeter is applied for approximately 40 minutes. After 40 minutes segment 101 may be moved to a storage area. In optional step 127, glue layers 116 and 118 are preferably left to cure for an additional day prior to use of the segment.

In the method illustrated in FIG. 3, the blocks are placed in direct contact with each other and are secured together with the modular wall segment solely by the external layers bonded to the opposite faces of the blocks. It may be desirable in some cases, however, to also include a quantity of a bonding material, such as cement, between the contacting faces of the blocks to augment their securement together within the modular wall segment by the external layers.

In optional step 129, a prepared segment 101 may be sawed to a desired size and shape, slots 114 may be cut, openings (e.g., for doors and windows) may be cut, channels (e.g., for electrical conduits) may be drilled. Slits and other configurations for joining one module to another, as described hereinbelow with reference to FIG. 4, may be prepared at this time.

The process described in FIG. 3 produces a modular wall segment 101 with desired characteristics. Segment 101 is strong, provides good thermal and acoustic isolation, yet is lighter and more easily worked than a wall of comparable shape and size constructed of cinderblock or construction blocks of other sorts. Segment 101 has smooth and aesthetically pleasing external surfaces with a finished appearance, ready for painting. Segment 101 may be cut to a desired width and shape using a saw. Walls constructed of modular wall segments 101 may be used for internal (non-load-bearing) walls. Segments 101 can also be used as an aesthetic surfacing material (inside or outside) for other types of walls, such as cast concrete exterior walls of a building. Segments 101 can be combined with insulating materials to constitute exterior walls of a building, as will be shown hereinbelow, and may be used to construct fences and similar structures.

In a preferred embodiment using YTONG blocks as aerated concrete blocks 113, a segment a square meter in area and seven centimeters thick weight approximately 42 kg, and meets the Israeli construction standards for acoustic insulation, for thermal insulation, and the Israeli mechanical strength standard #268. The wall segments so constructed are also fairly impervious to water but in wet environments it is recommended to spread a material impermeable to water on the module's surface before installation. HYDROGUM is an example of an appropriate material for this purpose. In a preferred embodiment, a recommended standard size for a modular wall segment is 60 cm in width and 260 cm in height, but modular wall segments can alternatively be constructed in various other shapes and dimensions.

Reference is now made to FIGS. 4*a* and 4*b* which present simplified cross-sectional views of two preferred methods for joining modular wall segments 101 into a continuous surface, thereby constructing a modularized wall, according to embodiments of the present invention. FIGS. 4*a* and 4*b* present partial views of a wall 131*a*, 131*b* consisting of two modular wall segments 133*a*, 133*b* and 135*a*, 135*b*, joined together at juncture 137*a*, 137*b*.

In FIG. 4A, glue is used to join a flat end of segment 133*a* to a flat end of segment 135*a*. Additionally, a slot 139 in segment 135*a* is so positioned that it faces a corresponding slot 141 in segment 133*a* when the two segments are to be joined. A connecting plate 143, which is preferably a metal plate, is coated with glue and positioned so as to substantially fill both slot 139 and slot 141. Glue thus fixes connecting plate 143 both to slot 139 of segment 133*a* and to slot 141 of segment 135*a*, and consequently serves to reinforce the joining of the two segments.

FIG. 4*b* shows an alternative method for joining the two segments 133*b*, 135*b*. In FIG. 4*b* an end of segment 135*b* is shaped as a rib 155, whereas an end of segment 133 is shaped with a slot or recess 161, the rib 155 being of a size and position to slide snugly into the recess 161 during construction of wall 131, where it is glued in place. Recess 161 is preferably dimensioned as described above with respect to slot 114 as shown in FIG. 1, or as described above with respect to slot 114' as shown in FIG. 2.

FIG. 4*b* also illustrates the alternative construction wherein each modular wall segment 101 is formed with a rib 155 at one end face, and with a slot 161 at the opposite end face, to enable a plurality of such segments to be assembled together in modular fashion.

Figures 5A, 5B, 5C:
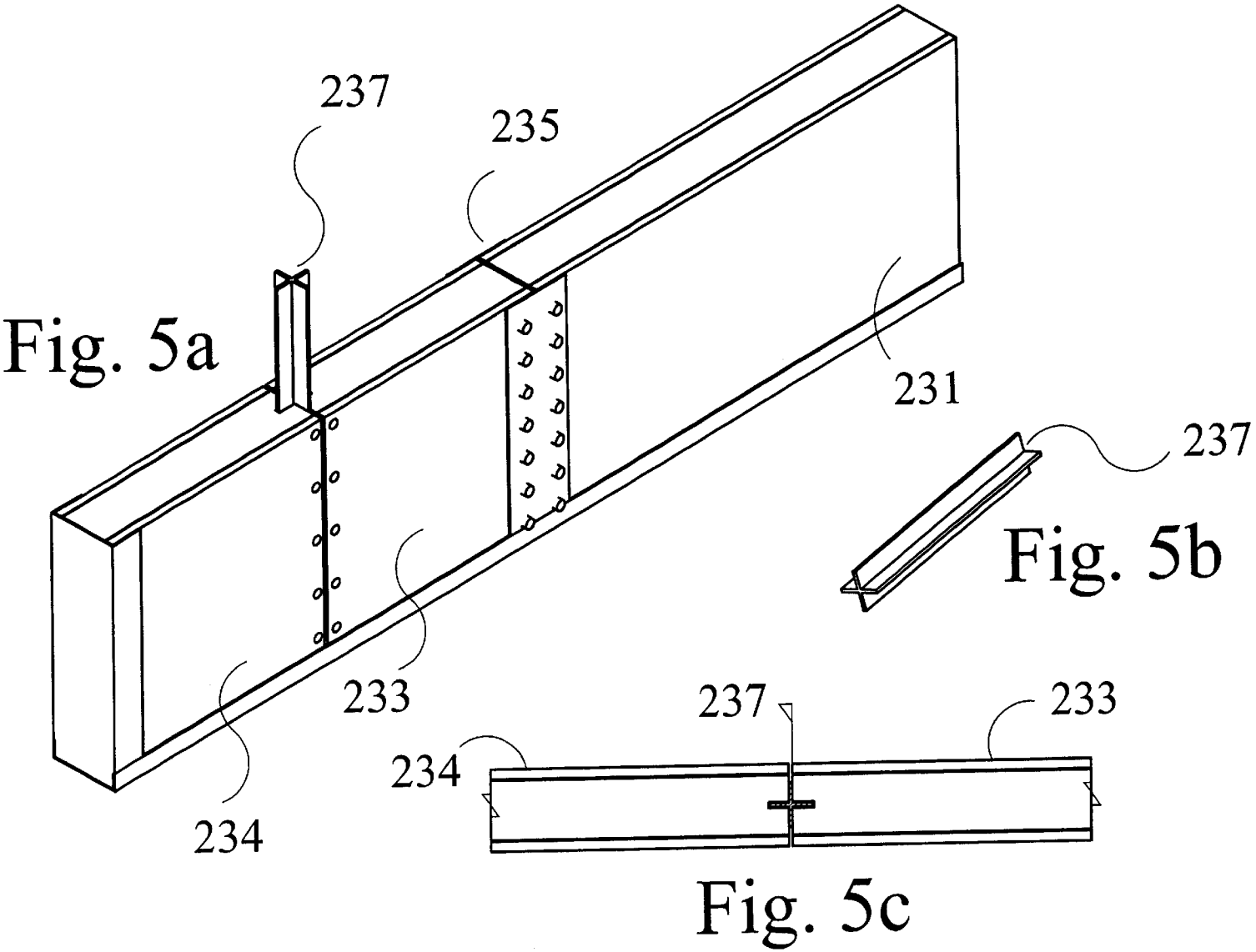
FIGS. 5*a* and 5*b* are simplified isometric views.
FIG. 5*c* is a cross-sectional view of further configurations for joining modular wall segments longitudinally, according to an embodiment of the present invention.

Reference is now made to FIGS. 5*a*–5*c*, which present simplified isometric and cross-sectional views of additional configurations for joining modular wall segments longitudinally, according to embodiments of the present invention. The joining configurations illustrated are particularly appropriate for the joining of modular wall segments for external use for example for external walls and for fences. The joining configurations illustrated are appropriate for horizontal configurations, joining a plurality of modular segments to make a long wall, and are also appropriate for vertical configurations, joining a plurality of segments to make a high wall.

In FIG. 5*a*, modular wall segment 231 is joined to modular wall segment 233 by use of an I-shaped joining element 235. Segments 231 and 233 are constructed with flat ends shaped to fit into I-shaped joining element 235, where they can be glued or preferably screwed or bolted into place. I-shaped joining element 235 is preferably of concrete or metallic composition, and consequently may be a load-bearing element.

FIG. 5*b* presents an isometric view of a cruciform joining element 237, preferably of metallic composition, which may also be used to join two modular wall segments longitudinally. The position in which cruciform joining element 237 may be placed is indicated in isometric presentation in FIG. 5*a*, and in cross-sectional presentation in FIG. 5*c*. In both FIG. 5*a* and FIG. 5*c*, cruciform joining element 237 is shown joining modular wall segments 233 and 234. Use of cruciform joining element 237 requires that slots be prepared in the ends of segments 233 and 234, similar to slots 141 and 139 of FIG. 4*a*.

Figure 6:
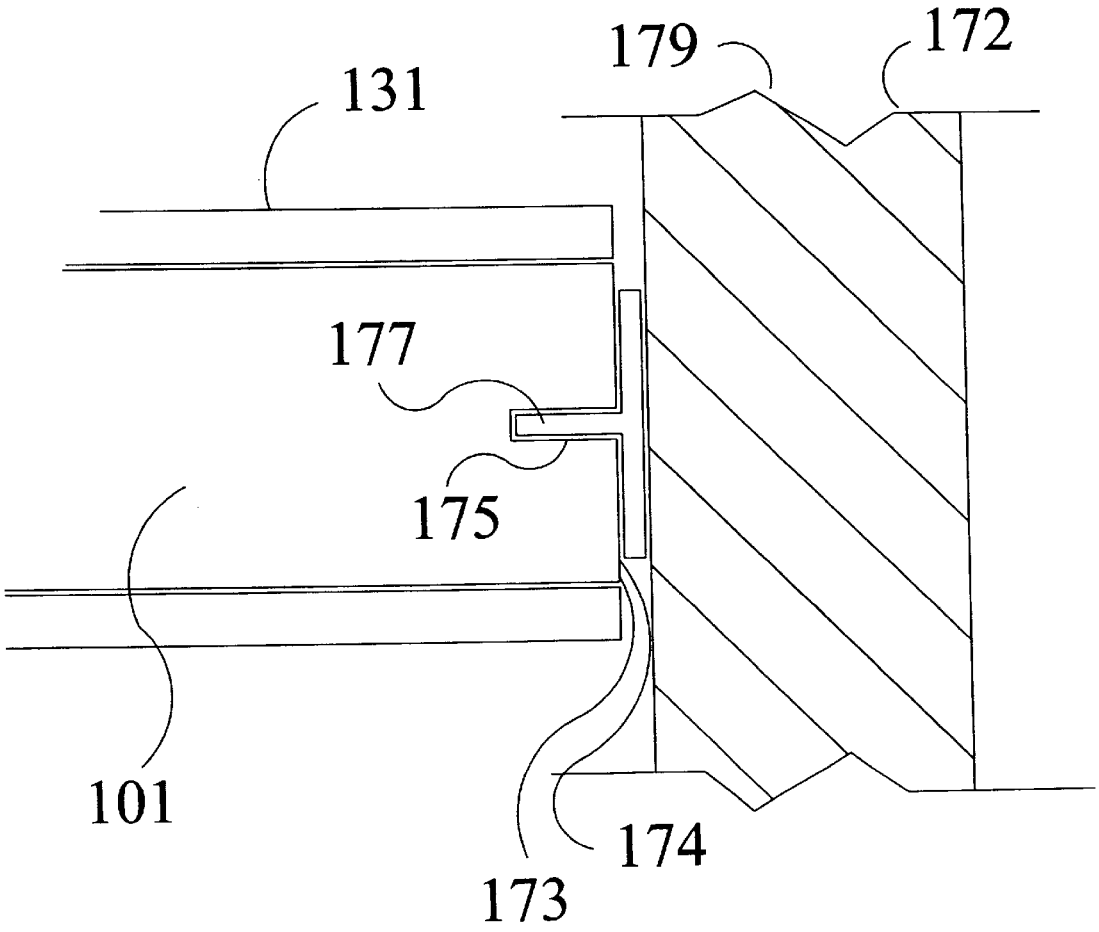
FIG. 6 is a simplified cross-sectional view of a configuration for joining a modular wall segment to a ceiling or to a floor, according to an embodiment of the present invention.

Reference is now made to FIG. 6, which presents a simplified cross-sectional view of a configuration for joining a modular wall segment to a ceiling or to a floor or to both a ceiling and a floor, according to an embodiment of the present invention. For connecting to a ceiling 178, modular wall segment 101 is prepared at its top end with a flat end face 173, in which a longitudinal slot 175 is prepared, running the length of end face 173. A T-shaped connecting form 177, preferably of metal, is screwed, bolted, glued or otherwise connected to ceiling 178 and is used to position modular wall segment 101 with respect to ceiling 178. T-shaped connecting form 177, shown in FIG. 6 as being more narrow than the thickness of modular wall segment 101, may alternatively be of width equal to the thickness of segment 101, or yet wider.

The configuration presented in FIG. 6 also serves for connecting modular wall segment 101 to a floor. Segment 101 is prepared also at its bottom end with flat face 174 in which a longitudinal slot 175 is prepared, running the length of bottom surface 174. A T-shaped connecting form 177, preferably of metal, is screwed, bolted, glued or otherwise connected to a floor 179 and is used to position modular wall segment 101 with respect to floor 179.

In typical use, an interior wall 131 is erected to partition an interior space by first attaching T-shaped connecting forms 177 to the floor and ceiling along most of the length along which it is desired to erect the wall 131, yet leaving a small section of the intended wall length with at least one form 177 (ceiling or floor) unattached, to create a staging area. Modular wall segments 101, constructed to be of an appropriate height and having longitudinal slots 175 along the top and bottom, are simply moved into the staging area, slotted onto T-shaped connecting forms 177, and slid along those forms, one segment 101 after another, until the space to be partitioned has been nearly filled and most of the wall 131 erected. A final segment, completing the wall 131, is erected in the staging area by slotting a final section of T-shaped connecting form 177 into a segment 101 before attaching form 177 to the ceiling or floor. Final segment 101 is erected in place, and final section form 177 is then attached to wall or floor as appropriate, completing construction of wall 131.

In a recommended mode of operation, a commercially available sealing agent, impervious to water, is spread on top surface 173, bottom surface 174, in slits 175, and on T-shaped connecting forms 177 before installing modular wall segments 101 on T-shaped connecting forms 177.

The configuration presented in FIG. 6 also serves for connecting modular wall segment 101 to a wall 172. In this usage T-shaped connecting form 177 is screwed, bolted, glued or otherwise connected to a wall 172 of any sort, such as, for example, a reinforced concrete exterior wall of a building. Form 177 can be connected to a flat end face of wall 172 to create a linear horizontal or a vertical extension of wall 172. Alternatively, form 177 can be connected to a side face of wall 172, to join wall 172 and segment 101 in a perpendicular or near-perpendicular configuration. Segment 101 is prepared with longitudinal slot 175 running the length of a flat end face, and an exposed portion of form 177, extending outward from wall 172 to which it is attached, is fitted into slot 175 to form a joint, which joint is then preferably reinforced using glue, screws, bolts, or similar materials.

Similarly, the configuration presented in FIG. 6 may also serve for connecting modular wall segment 101 to a second, like modular wall segment. In this usage, element 172 shown in FIG. 6 would also be a modular wall segment of the same construction as segment 101, and the T-shaped connecting form 177 would be screwed, bolted, glued or otherwise connected to wall segment 172, either to a flat end face thereof to create a linear horizontal or a vertical extension of wall segment 101, or to a side face thereof to join it to wall segment 101 in a perpendicular or near-perpendicular configuration. Segment 101 is prepared with longitudinal slot 175 running the length of a flat end face, and an exposed portion of form 177, extending outward from the other wall segment 172 to which it is attached, is fitted into slot 175 to form a joint, which joint is then preferably reinforced using glue, screws, bolts, or similar materials.

Figure 7A:
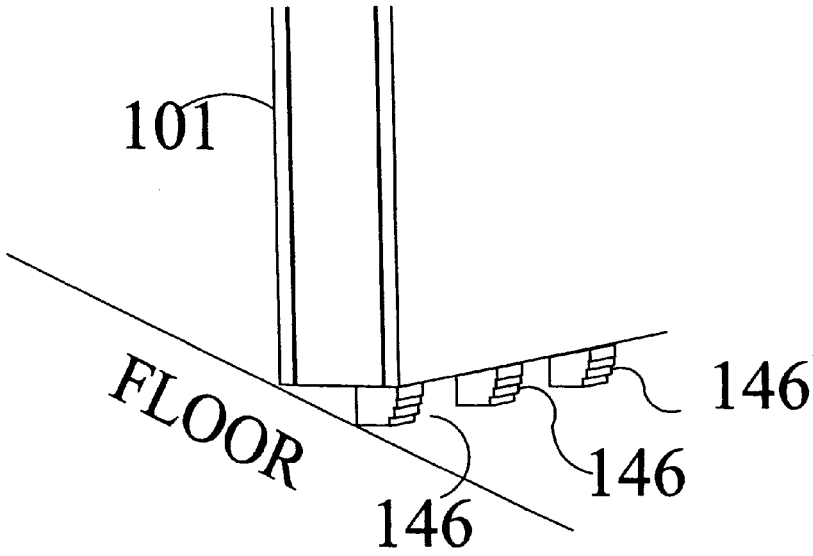
FIGS. 7*a* and 7*b* are simplified isometric views of a configuration for joining a modular wall segment to a floor which is not horizontal, according to an embodiment of the present invention.
Figure 7B:
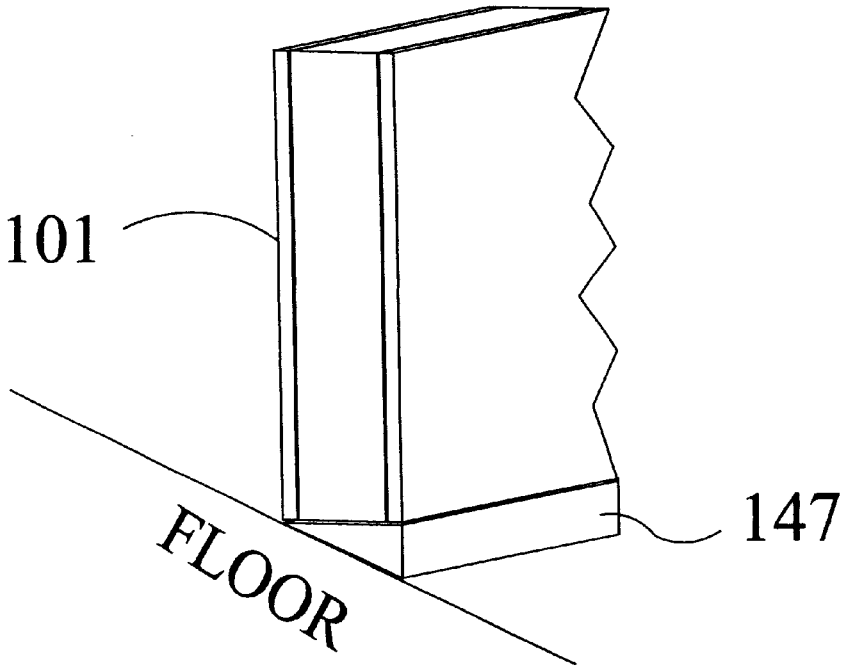

Reference is now made to FIGS. 7*a* and 7*b*, which present simplified isometric views of a configuration for joining modular wall segment 101 to a floor that is not horizontal, according to an embodiment of the present invention. In general, it is desirable to provide a horizontal floor surface at the point of installation of modular wall segments 101. This is preferably accomplished by casting a horizontal concrete strip, preferably about 7 cm in height and 4 cm thick, on which T-shaped connecting form 177 of FIG. 6, or other connecting forms or arrangements, or modular wall segment 101 itself, may be placed.

A further recommended mode of operation is presented in two phases in FIGS. 7*a* and 7*b*. In a first phase of operation shown at FIG. 7*a*, modular wall segment 101 is propped temporarily in a horizontal position using shims 146. Small sections of walling board, for example, may be used for this purpose. In a second phase of operation shown at FIG. 7*b*, a form is constructed around the base of modular wall segment 101, and a concrete strip 147 is cast under segment 101.

Figure 8:
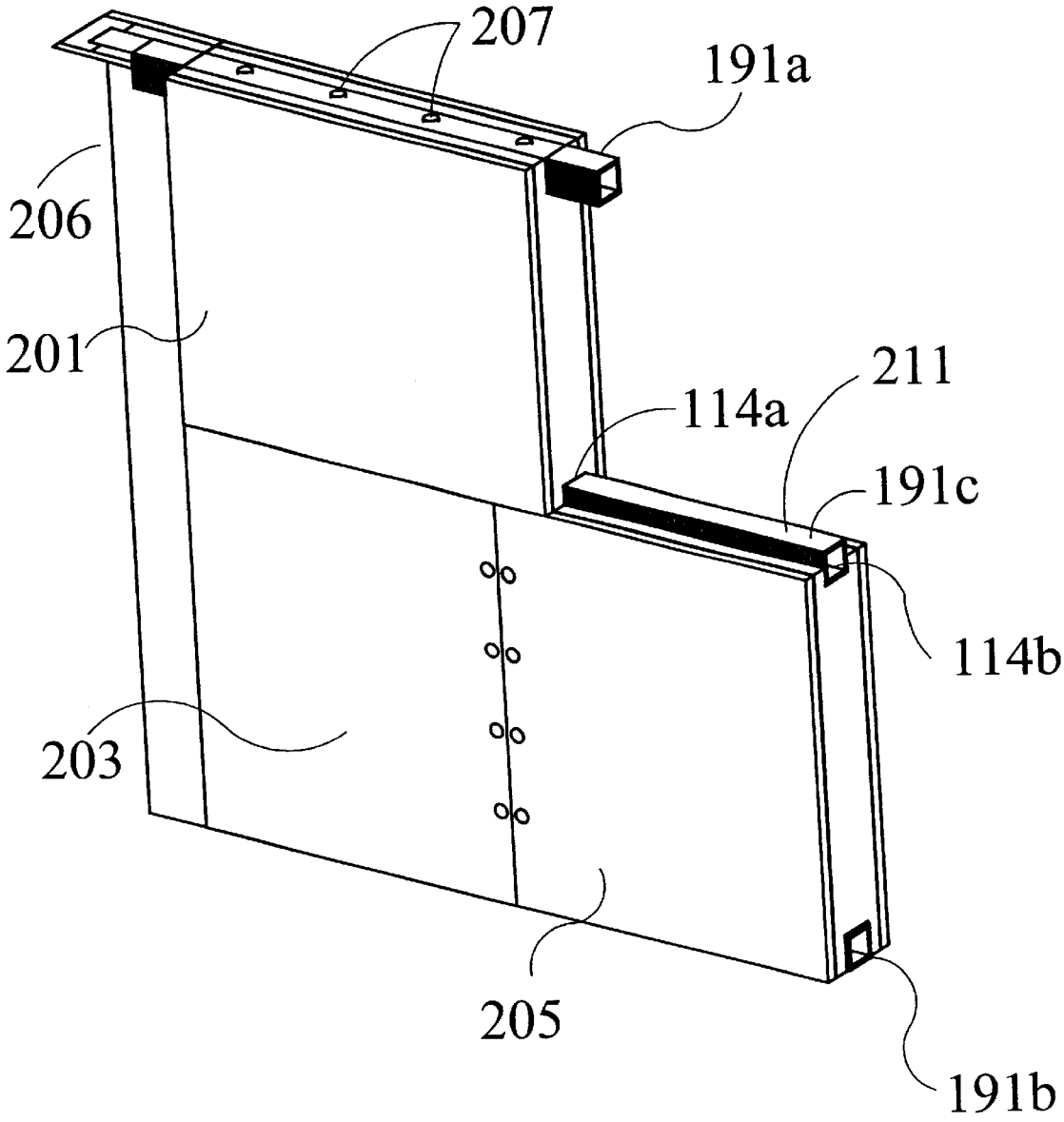
FIG. 8 is a simplified isometric view of further configurations for joining several modular wall segments one to another to make a wall, according to an embodiment of the present invention.

Reference is now made to FIG. 8, which presents a simplified isometric view of several additional configurations for joining several modular wall segments one to another to make a wall, according to an embodiment of the present invention.

In FIG. 8, elements 201, 203, and 205 are each modular wall segments (corresponding to segment 101 described earlier) here shown as joined one to another to make a wall 206. In FIG. 8 a rectangular connecting form 191*a*, illustrating an alternate construction serving the same function as that of T-shaped connecting form 177 in FIG. 6, is used to connect segment 201 to a ceiling. Holes 207 may be used to screw or bolt connecting form 191*a* to a ceiling. Similarly, a second connecting form, marked 191*b* is shown as the means by which segments 203 and 205 are connected to a floor.

A third connecting form 191*c* serves a different purpose. Connecting form 191*c* fits into a slot 114 at the bottom of segment 201 and into a slot 114*b* at the tops of segments 203 and 205, and serves to join segment 201 vertically to segments 203 and 205. This vertical joining method is useful when it is desired to build a wall taller than the maximum height of available individual wall segments 101. In an alternate construction, T-shaped connecting form 177, shown in FIG. 6, may be used in place of connecting form 191*c* to join segment 201 vertically to segments 203 and 205. In this case, T-shaped connecting form 177 in FIG. 6 is glued or otherwise attached to the bottom of segment 201 and fits into slot 114*b*, or is attached to the tops of segments 203 and 205 and fits into slot 114*a*.

Figure 9:
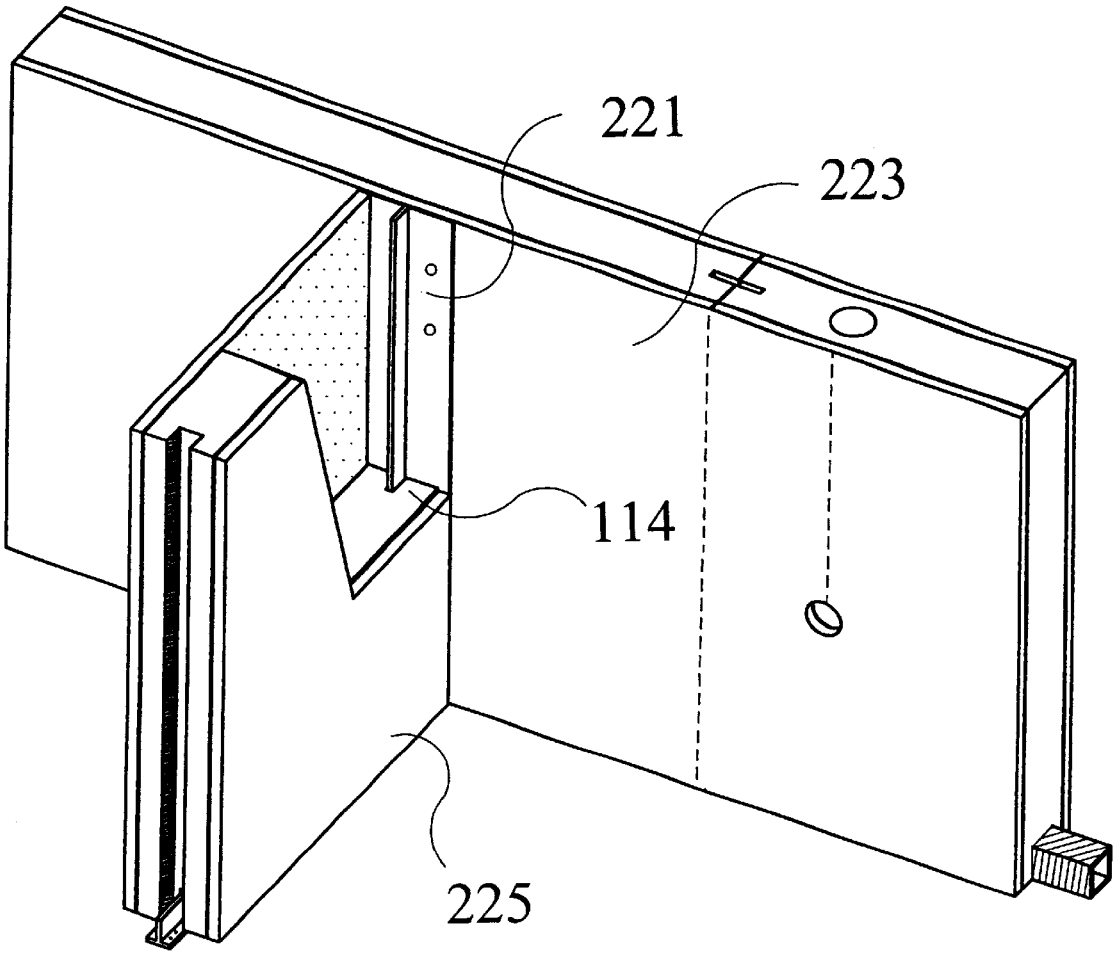
FIG. 9 is a simplified isometric view of a configuration for joining modular wall segments perpendicularly, according to an embodiment of the present invention.

Reference is now made to FIG. 9, which presents a simplified isometric view of a configuration for joining modular wall segments perpendicularly, according to an embodiment of the present invention. A connecting form 221, screwed, glued, bolted or otherwise attached to a side of a first modular wall segment 223, fits into a slot 114 in the end of a second modular wall segment 225. Connecting form 221 is then screwed, glued, bolted or otherwise attached in slot 114, thereby joining segment 223 to segment 225 perpendicularly.

Figure 10:
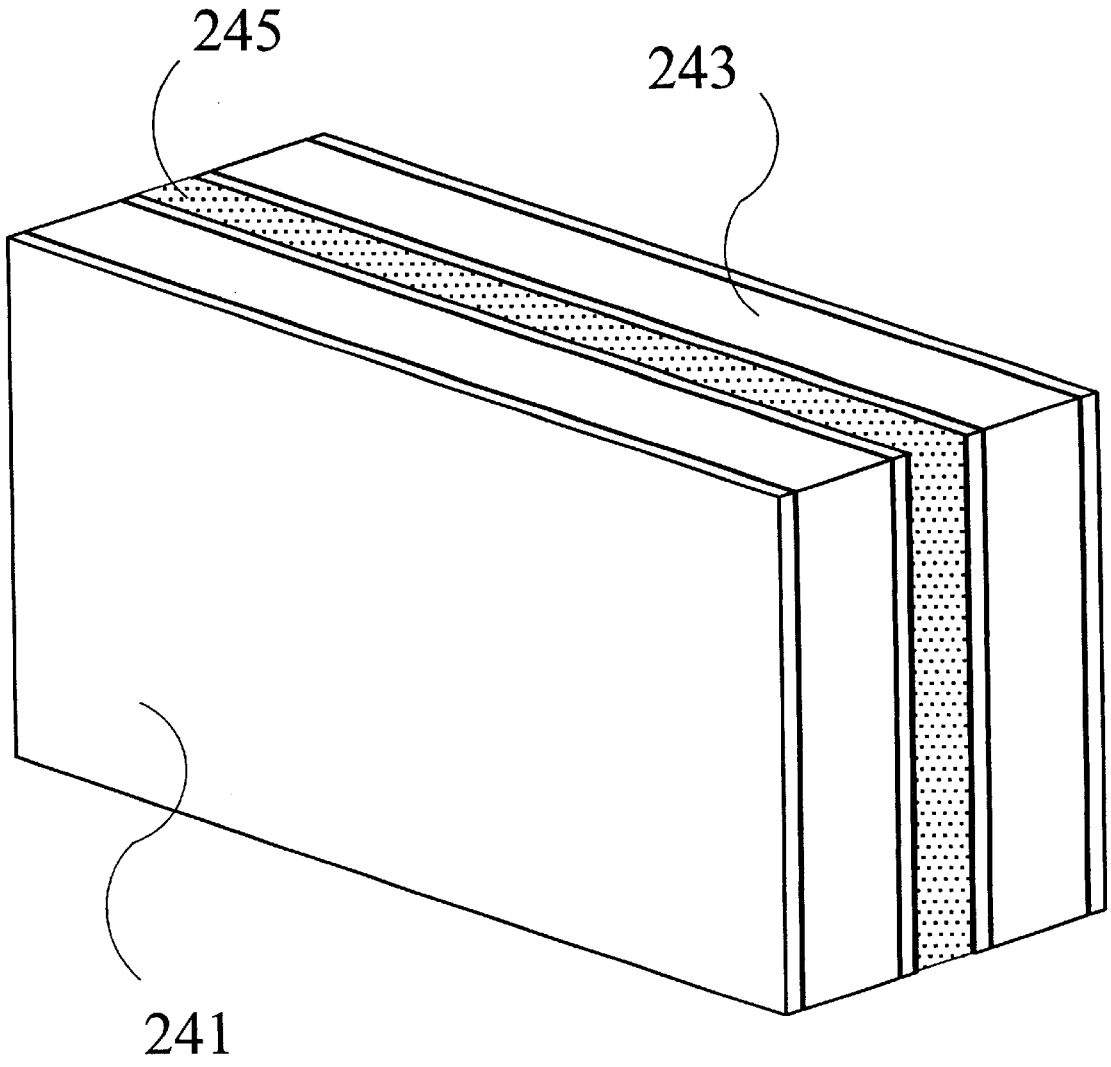
FIG. 10 is a simplified isometric view of a configuration for joining modular wall segments in parallel, according to an embodiment of the present invention.

Reference is now made to FIG. 10, which presents a simplified isometric view of a configuration for joining modular wall segments in parallel to produce a composite modular wall segment for constructing a wall and constituted of two of the above-described segments of the same dimensions joined together at the planar outer faces of their respective walling sheets. In such a composite configuration, insulating material 245, such as thermal insulation or acoustic insulation, is placed between, and may be attached (e.g. by gluing) to, both first modular wall segment 241 on a first side of said insulating material, and second modular wall segment 243 on a second side of said insulating material. This sandwich configuration thereby constructed is particularly recommended for use as an outside wall.

Figure 11:
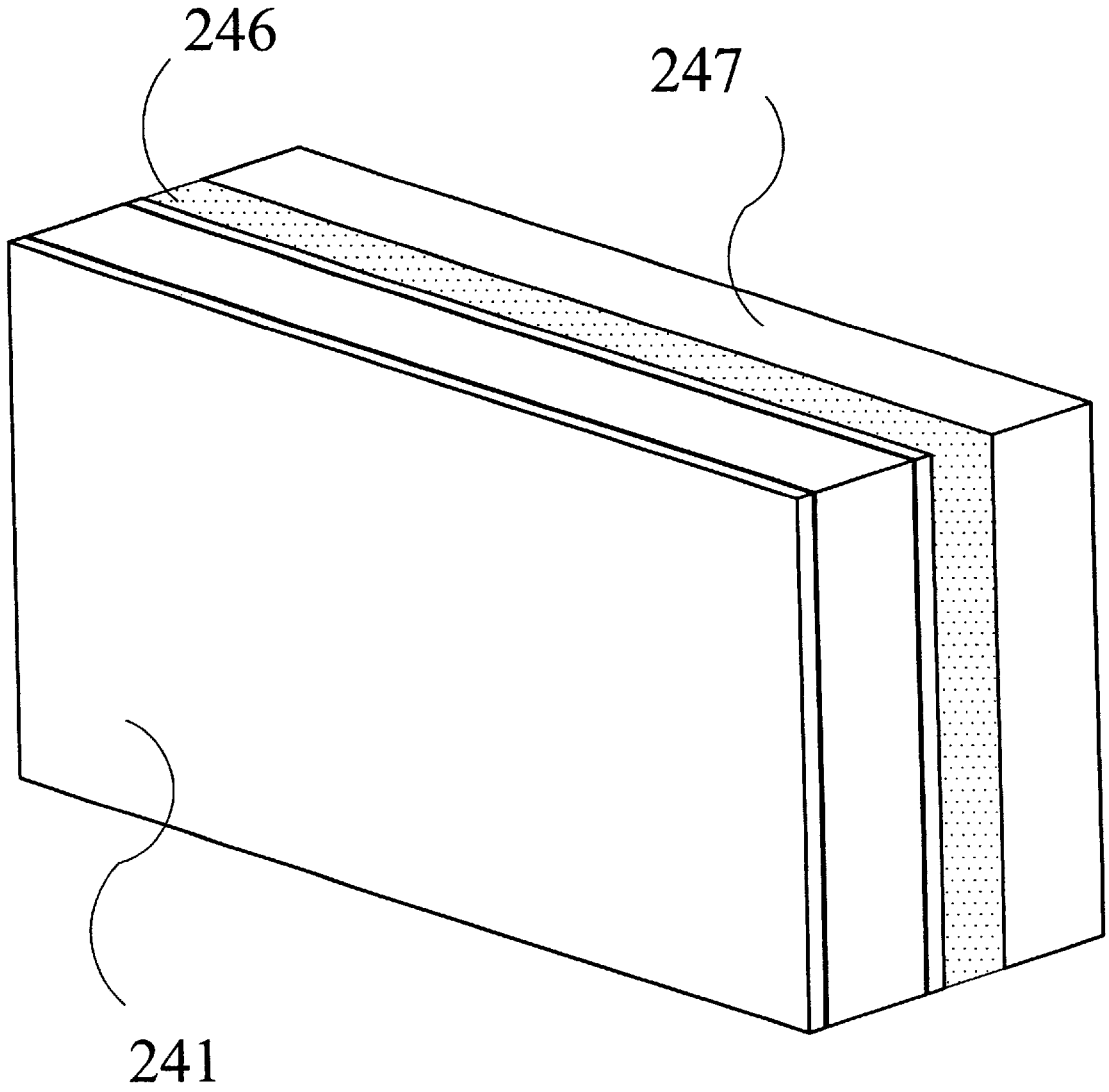
FIG. 11 is a simplified isometric view of a configuration for joining a modular wall segment to an exterior wall, according to an embodiment of the present invention.

Reference is now made to FIG. 11, which presents a simplified isometric view of a configuration for joining a modular wall segment to an exterior wall, according to an embodiment of the present invention.

Exterior wall 247 is typically not a modular wall segment 101, but rather is constructed by other means. Exterior wall 247 might be, for example, a poured concrete wall. Exterior wall 247 may be a load-bearing wall.

According to a preferred embodiment, exterior wall 247 is prepared to include bolts or other fasteners appropriately placed for use for connecting an interior wall. In a preferred mode of operation, waterproofing material is applied to exterior wall 247 if appropriate. Insulating material 246 of appropriate thickness is placed on the inner surface of exterior wall 247. Water pipes, drain pipes, conduits for electricity, for electronic communications, and optionally for other installations are installed at this time. Modular wall segment 241 is then connected to exterior wall 247 by means of bolts or other connectors provided for the purpose.

Figure 12:
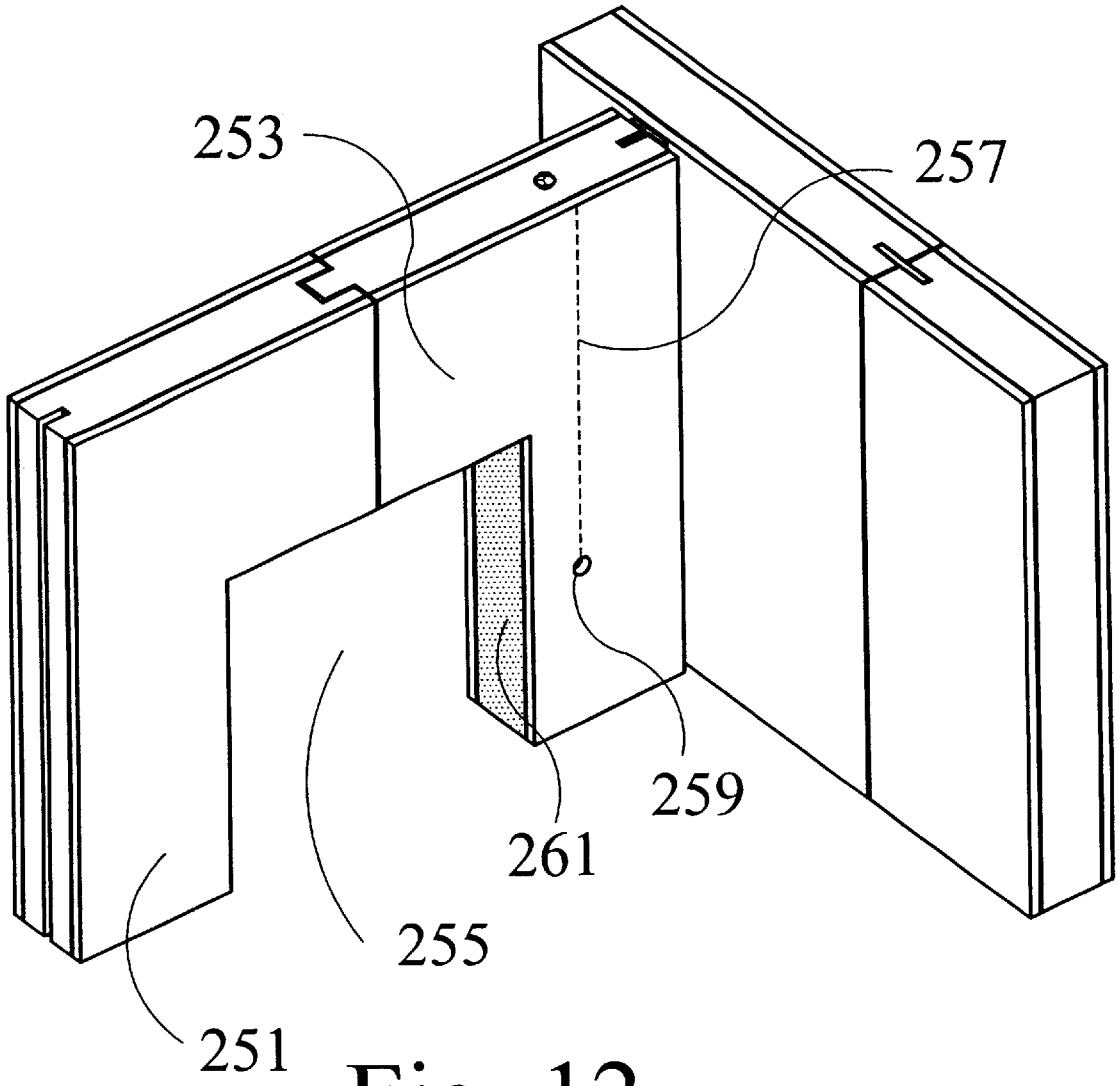
FIG. 12 is a simplified isometric view of a configuration of walls composed of modular wall segments and including pre-planned small and large openings, according to an embodiment of the present invention.

Reference is now made to FIG. 12, which presents a simplified isometric view of a configuration of walls composed of modular wall segments (e.g., 101 described earlier) and including pre-planned small and large openings, according to an embodiment of the present invention.

In a recommended mode of use when constructing walls of a building or part of a building utilizing embodiments of the present invention, detailed plans for the interior construction, based on architects drawings and engineers specifications, are taken into account in the planning, design, and construction of appropriately sized and shaped modular wall segments. Users of the modular wall segments (typically, the construction crew) provide makers of the wall segments (typically, a commercial supplier or factory) with detailed specifications of the sizes and placements of the walls and the desired positions of openings such as windows and doors, and desired smaller penetrations in the walls for elements such as channels for electrical conduits and openings such as for electrical outlets. The makers of the wall segments can then design segments of accurately appropriate sizes, and use the manufacturing facilities of their workshop or factory to cut or drill appropriate openings in the constructed modules, which process can be accomplished with ease and accuracy in the factory or industrial setting.

In FIG. 12, modular wall segment 253, for example, comprises a prepared channel 257 for electrical wiring and a prepared opening 259 for an electrical connection. Segments 251 and 253 are shown in FIG. 12 to have been shaped or cut so as to provide an opening 255 appropriate for a door. Optionally, a wooden door frame base 261 is provided glued to, or embedded in, segments 251 and 253. Wooden door frame base 261 is of great utility in providing for elegantly finished doors within the constructed walls, in that door frame base 261 can be accurately measured and affixed to the segments during production of the segments, thus requiring no cutting or shaping of the segments at the construction site. An aesthetically pleasing external door frame element (not shown) can easily be affixed to door frame base 261 at the construction site, for example using glue and a staple gun.

In a preferred mode of operation, the makers of the module carefully number and mark each module, identifying its place in the installation plan. The construction crew at the building site can prepare the appropriate connecting forms attached to floors, ceilings, and exterior walls according to the same plan. On delivery of the prepared modular wall segments to the building site, the building crew can easily and rapidly erect the walls on the prepared connecting forms, and all openings and penetrations designed by the building's architects and engineers will be accurately in place and present a finished appearance. If needed, the builders may apply small amounts of filler to cover any cracks caused by the installation process, and the walls are finished and ready for a coat of paint.

Should it be desired to strengthen modular segment 101 beyond the strength required for normal construction and beyond the strength requirements of standard building codes, metallic elements, such as metal reinforcement wires, nettings or cages, may be added to the sandwich construction during the construction phase of the modular segments described with reference to FIG. 3, thereby further strengthening the modular wall segments. It is, however, generally an advantage of the described modular wall segment (e.g., 101) that such strengthening elements are usually unnecessary, and the fact that the segments typically contain no metallic elements adds convenience, in that no care need be takes to locate and to avoid internal metallic elements when cutting or drilling the segments.

Figure 13:
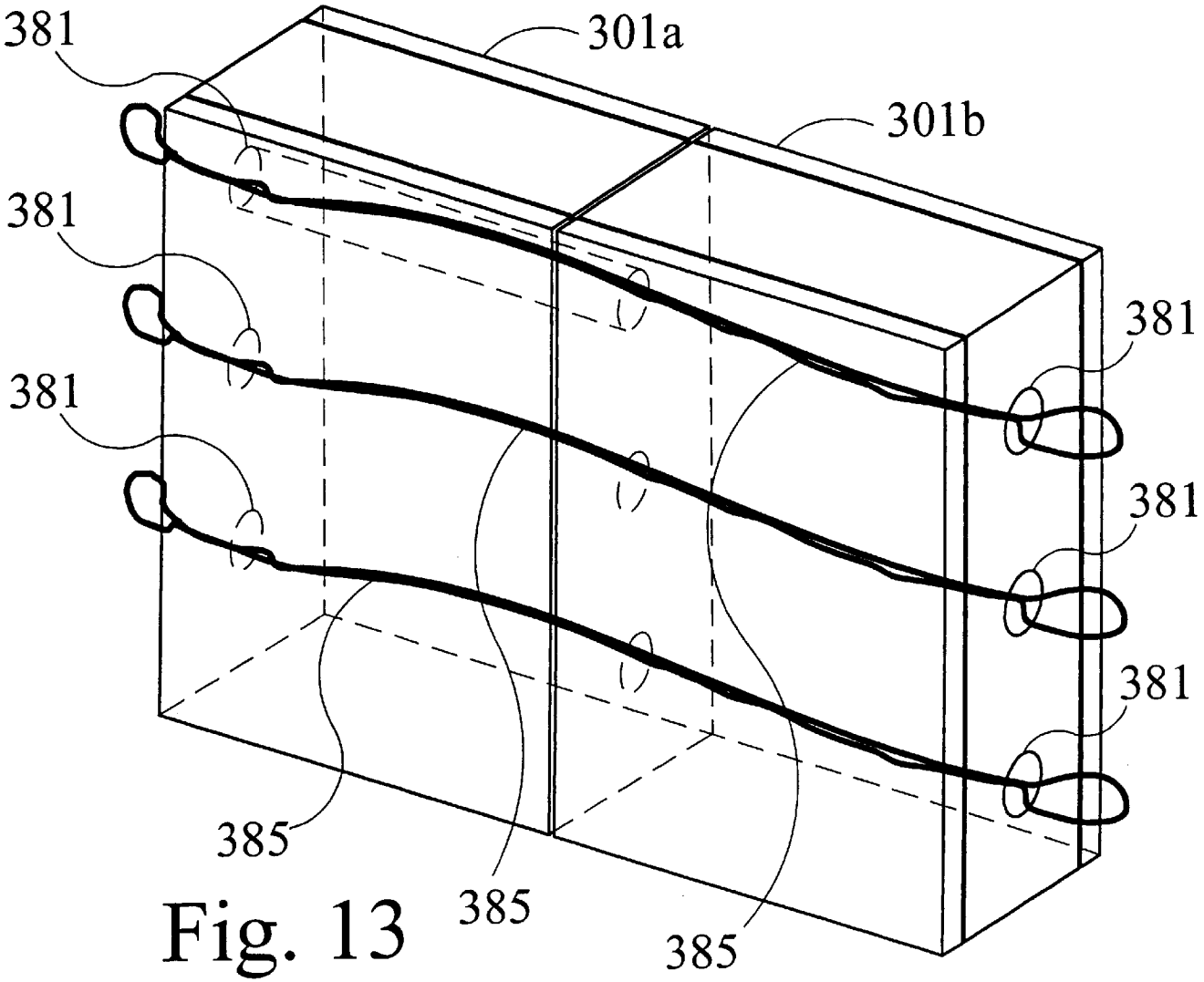
FIG. 13 is a simplified cross-sectional view of modular walls segments in a configuration reducing danger from earthquakes, according to an embodiment of the present invention.

Reference is now made to FIG. 13, which is a simplified isometric view of a configuration for reducing danger from earthquakes, according to an embodiment of the present invention. Experience has shown that during seismic disturbances, some or all of the load-bearing structures of a building may survive intact or nearly intact, yet people are endangered and property destroyed because of falling masonry from a building's interior walls. FIG. 13 presents a configuration of modular wall segments 301*a*, 301*b* joined to form a wall in a manner which enhances security of the wall in the face of seismic disturbances. Modular wall segments 301*a* and 301*b* have been prepared with interior channels 381 drilled or otherwise constructed running lengthwise of the length of the modular segments. In FIG. 13, three such channels are shown. Each channel 381 is for accommodating a cable 385, which is made to pass through channel 381 in segment 301*a*, and also through channel 381 in segment 301*b*, thereby linking segments 301*a* and 301*b* with a strong metallic cable. The ends of cable 385 are firmly attached to load-bearing structures of a building, such as a steel framework, or a steel-reinforced poured concrete element. In the event of an earthquake or other major trauma to the building structure, if the load-bearing structures to which cables 385 are anchored survive the disturbance, modular wall segments 301*a*, 301*b* are held together, and may largely be prevented from falling and doing damage, by cables 385. The configuration shown in FIG. 13 substantially reduces risk that segments 301*a*, 301*b* will fall from place and endanger lives and property during a seismic disturbance.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A modular wall segment for constructing a wall, comprising:

(a) a first walling sheet of a selected two-dimensional shape and size;

(b) a second walling sheet of said selected two-dimensional shape and size; and (c) a plurality of aerated concrete blocks contiguously located in a plurality of rows and columns between said first and second walling sheets to form a volume of consistent thickness of said selected two-dimensional shape and size;

said plurality of aerated concrete blocks being bonded on their opposite faces to said first and second walling sheets and contiguously placed in direct contact with each other and secured together within the modular wall segment solely by said walling sheets.

2. The modular wall segment according to claim 1, wherein the modular wall segment is formed on at least one end face with a slot for receiving a fastening element to secure the modular wall segment to other modular wall segments.

3. The modular wall segment according to claim 2, wherein said slot extends longitudinally through all the aerated concrete blocks at the respective end of the modular wall segment.

4. The modular wall segment according to claim 2, wherein said slot is defined by the two walling sheets projecting outwardly past the plurality of aerated concrete block at the respective end of the modular wall segment.

5. The modular wall segment according to claim 4, wherein the modular wall segment includes a U-shaped channel member received in said slot.

6. The modular wall segment according to claim 2, wherein one end face of the modular wall segment is formed with said slot, and the opposite end face of the modular wall segment is formed with a rib dimensioned to be received in said slot of another like modular wall segment.

7. The modular wall segment according to claim 2, in combination with a fastening element dimensioned to be received in said slot to secure the modular wall segment to another modular wall segment.

8. The modular wall segment according to claim 7, wherein said fastening element is a fastening bar dimensioned to be received in said slot of two aligned modular wall segments to secure them together.

9. The modular wall segment according to claim 8, wherein said fastening bar is of a cruciform cross-section.

10. The modular wall segment according to claim 8, wherein said fastening bar is of a T-cross section.

11. The modular wall segment according to claim 8, wherein said fastening bar is of a hollow rectangular cross-section.

12. A composite modular wall segment for constructing a wall constituted of two wall segments each according to claim 1, wherein said two segments are of the same dimensions, include walling sheets having planar outer faces, and are joined together at their planar outer faces to define the composite modular wall segment for constructing a wall.

13. The composite modular wall segment according to claim 12, wherein said composite modular wall segment includes an insulating layer between said two joined segments.

14. The modular wall segment according to claim 1, wherein said segment includes reinforcement cables passing through said plurality of aerated concrete blocks.

15. The modular wall segment according to claim 14, wherein said reinforcement cables are passed through channels formed in said plurality of aerated concrete blocks and terminate in ends securable to load-bearing structures to provide protection against earthquakes.

16. The modular wall segment according to claim 1, wherein at least one of said walling sheets is of the group consisting of plywood, gypsum board, cement-board, composition-board, plasterboard and wallboard.

17. The modular wall segment according to claim 1, wherein said plurality of aerated concrete blocks are bonded by adhesive layers to said first and second walling sheets.

18. A building structure including walls made of a plurality of modular wall segments according to claim 1 secured together.

* * * * *